US010086640B2

(12) United States Patent
Kish

(10) Patent No.: US 10,086,640 B2
(45) Date of Patent: Oct. 2, 2018

(54) RETRACTABLE HOLDER FOR WRITING, POINTING INSTRUMENTS

(71) Applicant: Louie Kish, Santa Ana, CA (US)

(72) Inventor: Louie Kish, Santa Ana, CA (US)

( * ) Notice: Subject to any disclaimer, the term of this patent is extended or adjusted under 35 U.S.C. 154(b) by 115 days.

(21) Appl. No.: 15/286,057

(22) Filed: Oct. 5, 2016

(65) Prior Publication Data

US 2017/0096027 A1 Apr. 6, 2017

Related U.S. Application Data

(60) Provisional application No. 62/237,465, filed on Oct. 5, 2015.

(51) Int. Cl.
*B25B 29/00* (2006.01)
*B43K 23/00* (2006.01)

(52) U.S. Cl.
CPC ..... *B43K 23/001* (2013.01); *B25B 29/00* (2013.01)

(58) Field of Classification Search
CPC ..... B43K 23/001; B25B 29/00
See application file for complete search history.

(56) References Cited

U.S. PATENT DOCUMENTS

| | | | | |
|---|---|---|---|---|
| 6,591,461 | B2 * | 7/2003 | Salentine | A45F 5/004 24/115 F |
| 6,854,681 | B2 | 2/2005 | Kish | |
| 7,270,289 | B2 * | 9/2007 | Kish | A45F 5/004 224/162 |
| 2015/0183262 | A1 * | 7/2015 | Collins, III | B43L 23/00 30/451 |
| 2015/0274260 | A1 * | 10/2015 | McCabe | B63B 21/20 114/44 |

* cited by examiner

*Primary Examiner* — Sang K Kim

(57) ABSTRACT

A utility retractor having a utility adaptor, and having a retractable tether comprised of Ultra High Molecular Weight Polyethylene (UHMWPE) material. The UHMWPE exhibits many important qualities suitable in a utility retractor, including abrasion resistance, the ability to be knotted without tangling, and it is very slippery to achieve a significant useful life. The retractor may also include an energy absorber disposed on the tether configured to prevent the danger of the utility adapter flailing indiscriminately during retraction. The energy absorber can be selectively positioned.

12 Claims, 4 Drawing Sheets

RETRACTABLE HOLDER FOR WRITING, POINTING INSTRUMENTS

CLAIM OF PRIORITY

This application claims priority under 35 U.S.C. 119(e) of U.S. Provisional Patent application U.S. Ser. No. 62/237,465 filed Oct. 5, 2015, entitled Retractable Holder for Writing, Pointing Instruments, the teachings of which are incorporated herein in their entirety.

FIELD OF THE INVENTION

This disclosure relates to the field of holding writing or pointing instruments, such as to tethering any number of items, including hand tools such as screwdrivers.

BACKGROUND

Many people use writing, marking or pointing instruments, or small hand tools (hereinafter referred to generally as "instruments"), in their trade, hobby or leisure times. These instruments may be in the shape of a carpenter's pencil, felt tip marker, regular pencil, golf pencil, "clicker" or stick pen, stylus or a pointer or screwdriver or awl. In many situations the users of these instruments are moving from place to place as they perform their task. One of the more frustrating and time wasting aspects of these tasks is when they drop or misplace their instrument. In addition, having to use many tools to accomplish a task is always a challenge.

One of the drawbacks to existing products is the significant impact of the environment in which the holder is used. The tether is subjected to wear and tear due to the abrasion when it rubs on tools, clothing, tool pouches, and even the body of the retractable reel.

What is needed is a different kind of tether material that has many different qualities, including being highly resistant to abrasion, tough to cut, able to be tied in a tight knot but not become easily tangled, and also that is very slippery. Finding such a unique material and incorporating it into a retractable reel will offer other benefits such as the ability to mark the tether for custom measurements, possible replacing a tape measure, reducing the need to carry multiple tools for tasks. Use of stronger materials can also lead to smaller retractors to achieve the same length.

The cable/tether must meet requirements or strength, abrasion resistance and an ability to withstand multiple windings. The vast majority of conventional retractors use typical materials such as nylon and polyester. They are relatively inexpensive, exhibit some abrasion resistance, can be wound and rewound many times, and are easy to work with in production. Where higher tinsel strength is required, a Kevlar material is utilized. One may conclude that a metal cable would be a good fit for this application, however, stranded cable will bind over time, and coated stranded cable becomes bulky and can also bend and bind.

When investigating other applications for tethers, one can find that a monofilament cord used for fishing can be made in various strengths and is generally very abrasion resistant. Unfortunately, this type of material is easy to tangle, has memory, does not bend tightly, and is not so easy to assemble into the needed retractors.

SUMMARY

A utility retractor having a retractable tether comprised of Ultra High Molecular Weight Polyethylene (UHMWPE).

Also known as high-modulus polyethylene (HMPE), or high-performance polyethylene (HPPE), UHMWPE has extremely long chains, with a molecular mass usually between 2 and 6 million u. The longer chain serves to transfer load more effectively to the polymer backbone by strengthening intermolecular interactions. The UHMWPE is a very tough material, with the highest impact strength of any thermoplastic presently made. A critical quality to this disclosure is its ability for being very slippery and able to resist the environmental pitfalls common in the industry. Tests show a 10× increase in lifetime use of the utility retractor utilizing the UHMWPE tether.

UHMWPE is odorless, tasteless, and nontoxic. It is highly resistant to corrosive chemicals except oxidizing acids; has extremely low moisture absorption and a very low coefficient of friction; is self-lubricating; and is highly resistant to abrasion, in some forms being 15 times more resistant to abrasion than carbon steel. Its coefficient of friction is significantly lower than that of nylon and acetal, and is comparable to that of polytetrafluoroethylene (PTFE, Teflon), but UHMWPE has better abrasion resistance than PTFE.

DETAILED DESCRIPTION

Exemplary embodiments disclosed herein are directed to a retractable device for retaining writing, marking or pointing instruments at an accessible location for an individual. Generally, the retractable device is composed of a retractable reel coupled to a flexible member that is sized to engage an instrument. The flexible member may be selectively extended and retracted to provide better access to the instrument. The flexible member includes a first bore and a second bore. The first bore is sized to receive a connector from the retractable reel. The second bore has a varying inner diameter thereby allowing instruments of various sizes to be held within the flexible member.

According to various exemplary embodiments, the retractable device may include fasteners to reversibly couple the retractable device to the user or other readily accessible surfaces. For example, one exemplary embodiment of the retractable device utilizes a clip that allows the device to be coupled to the belt or pants of the user. In another exemplary embodiment, the device includes a shaft that extends from the device that may be placed within a pencil holder or the like.

The detailed description set forth below in connection with the appended drawings is intended as a description of exemplary embodiments and is not intended to represent the only forms in which the exemplary embodiments may be constructed and/or utilized.

Figure 1:
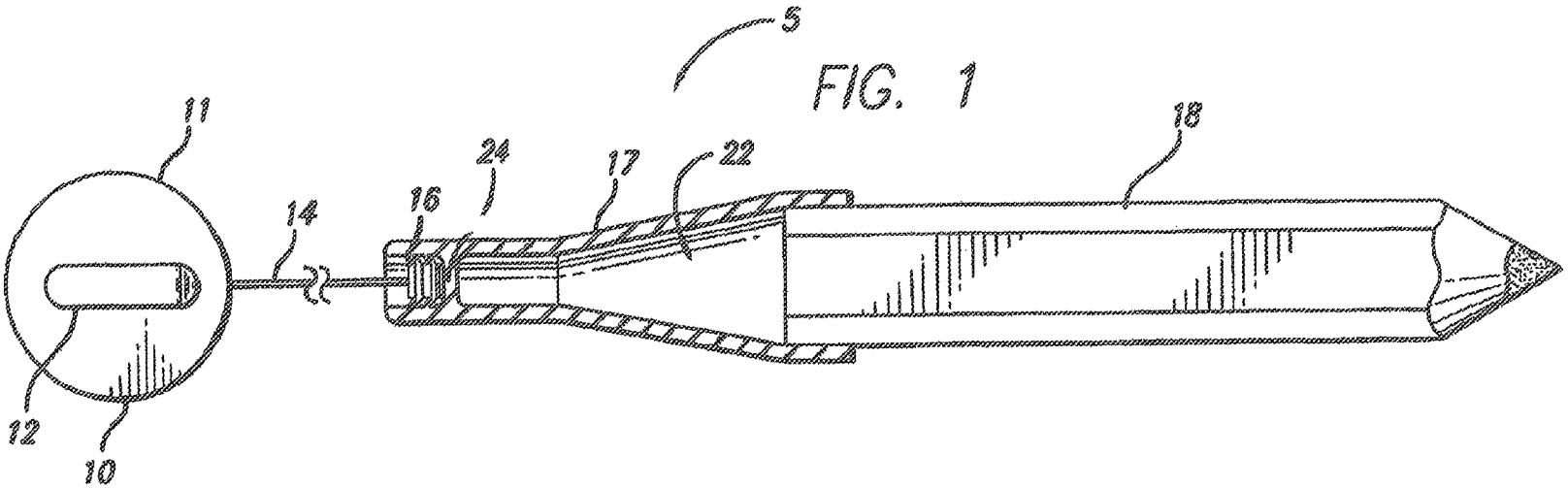
FIG. 1 is a cross-sectional view of an exemplary embodiment engaging a large diameter instrument.

Turning to the drawings, FIG. 1 is directed to one exemplary embodiment of a retractable. Instrument holder 5. As shown in FIG. 1, the retractable instrument holder 5 is composed of a retractor 11 coupled to a flexible retaining member 17 comprising an adaptor. In the exemplary embodiment as shown in FIG. 1, the retractor 11 is a conventional type retractor having a housing 10 and a fastening means 12 for attaching the retractor 11 to an individual's clothing, or a clipboard, an ear sun visor, or a pencil holder. The fastening means 12 may be a belt clip or a bulldog clip, clamps such as alligator clamps, hooks or other coupling structures known or developed in the art.

The retractor 11 has an internal retractable reel connected to a cable 14, also referred to as a tether in this application, that can be extended approximately 2 to approximately 4+ feet from the reel, although the length of the cable 14 may be varied to accommodate various intended uses. According to this disclosure, the utility retractor includes cable 14 comprised of UHMWPE, which will be described in more detail shortly.

Figure 2:
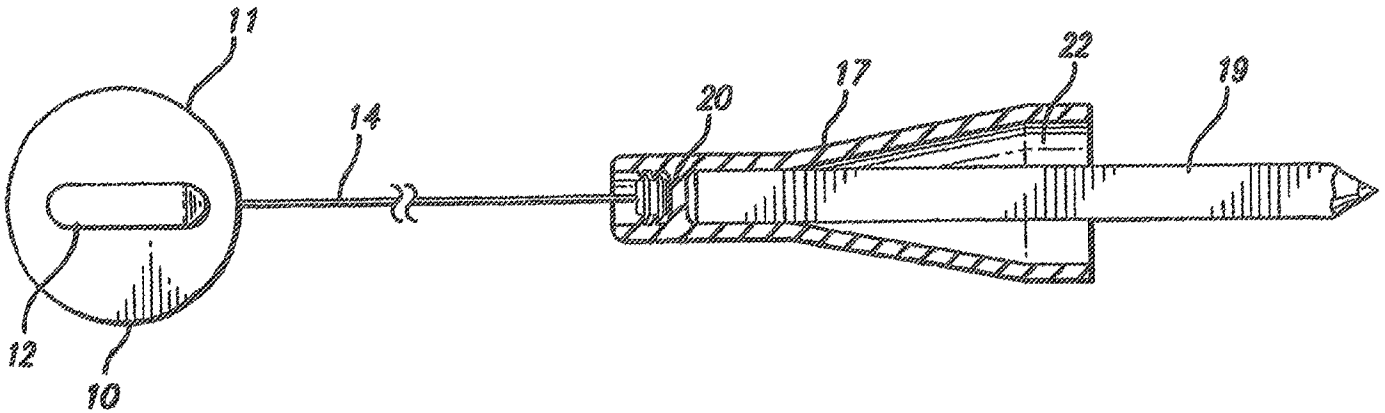
FIG. 2 is a cross-sectional view of an exemplary embodiment engaging a small diameter instrument.
Figure 3:
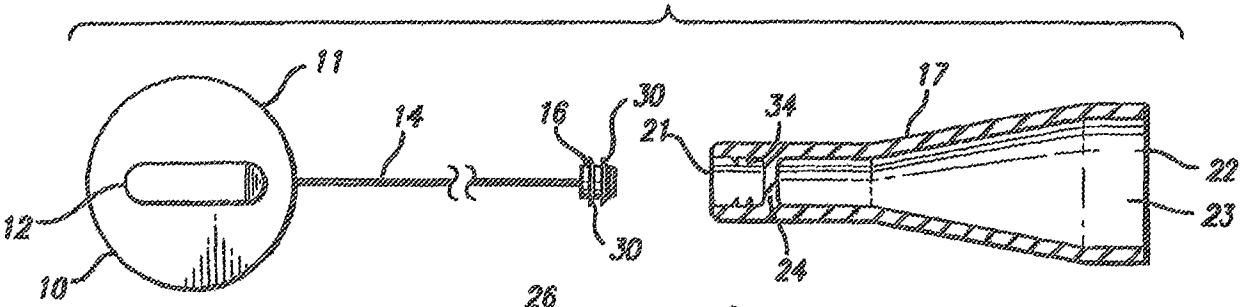
FIG. 3 is an exploded side cross-sectional view of an exemplary embodiment.
Figure 5:
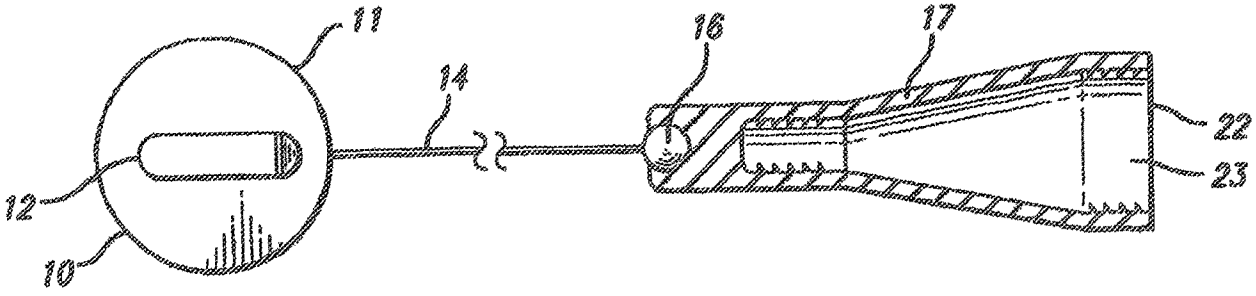
FIG. 5 is a cross-sectional side view of another exemplary embodiment.

As shown in FIG. 1, a plug 16 is attached to one end of the cable 14. According to one exemplary embodiment, the plug 16 may be a generally cylindrical structure having annular ridges 30 provided about the outer diameter as shown in FIGS. 1-3. In another exemplary embodiment, the plug 16 may not include the annular ridges on the outer diameter. In yet another exemplary embodiment, the plug 16 may be a generally spherical structure as shown in FIG. 5. In another exemplary embodiment, the plug 16 may be provided with threads 32 on the outer diameter. As those skilled in the art will appreciate, the plug 16 may have a plurality of shapes and be made from a plurality of materials such as, but not limited to, plastic, metal, alloys, ceramics, or the like.

As shown in FIG. 1, the plug 16 is inserted into a bore 21 that is positioned at one end of the flexible retaining adaptor 17. According to one exemplary embodiment, the plug 16 is held by friction fit against the inner walls of the bore 21. To achieve a friction fit, the diameter of the plug 16 may be slightly larger than the diameter of the bore 21. In other exemplary embodiment, the plug 16 having annular ridges 30 may engage corresponding annular ridges 34 provided on the bore 21 to retain the plug 16 in the bore 21. In yet another exemplary embodiment, the threads 32 provided on the plug 16 may engage and mate with corresponding threads 36 provided on the Walls of the bore 21. In another exemplary embodiment, the plug 16 may be snap-fitted into the bore 21 as shown in FIG. 5.

Figure 6:
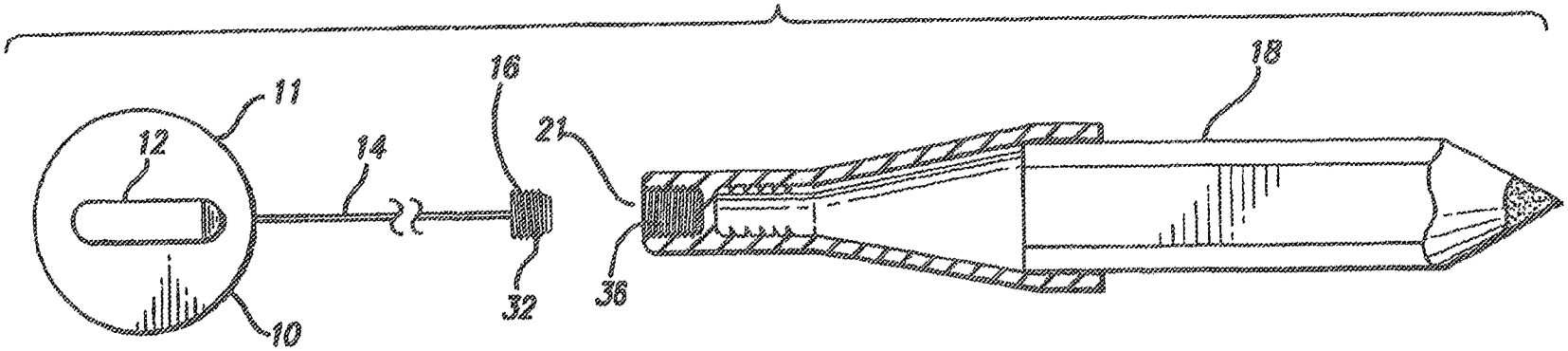
FIG. 6 is a cross-sectional side view of yet another exemplary embodiment.

As shown in FIG. 1, the flexible retaining adapter 17 has a generally funnel-shaped body. The adapter has a bore 21 that is sized to receive a plug 16. The bore 21 may have smooth inner walls in one exemplary embodiment. In another exemplary embodiment, the walls may have annular ridges 34 extending into the bore 21 as shown in FIG. 3. In yet another exemplary embodiment, the bore 21 may have threads along the inner walls of the bore 21 as shown in FIG. 6. The adapter 17 also includes a wall 24 that separates the bore 21 from the main cavity 22. The main cavity 22 has a cross-section that diminishes as it approaches the wall 24 that separates the cavity 22 from the bore 21. The decrease in diameter of the main cavity walls provides a universal adapter that is sized to engage a wide variety of writing, marking, or pointing instruments of different diameters to be securely held by a frictional fit.

The adapter 17 may be made of a plurality of materials that have the characteristic of being relatively stiff, yet slightly resilient. Exemplary materials include, but are not limited to, vinyl or rubber.

According to various exemplary embodiments, as shown in FIGS. 1-3, the inner walls of the main cavity 22 are generally smooth. In alternate embodiments, as shown in FIGS. 5 and 6, the inner walls of the main cavity 22 may be provided with annular ridges that extend away from the walls of the main cavity 22.

The adapter is capable of housing various instruments of different diameter sizes due to the resilient nature of the material and the varying diameters of the cavity 22. For instance, as shown in FIG. 1, the adapter 17 is capable of housing an instrument having a large diameter such as a carpenter's pencil 18. That is, these large diameter instruments are inserted into the mouth of the adapter 17 and the inner walls of the adapter engage the outer walls of the instruments. As shown in FIG. 2, the adapter 17 is capable of holding those instruments 19 having smaller diameter. That is, the inner walls of the cavity 22 that are near the inner wall 24 are capable of engaging the small diameter instrument. Furthermore, the adapter 17 is capable of engaging instruments having irregular cross-sections so long as the instruments are inserted into the cavity 22 to sufficiently form a tight frictional fit with the instrument. Additionally, the instrument may be removed from the cavity 22 with a sufficient pulling force to overcome the frictional fit and be replaced with another instrument.

In another exemplary embodiment, the retractor 11 includes a pencil-rod attachment 25. This attachment 25 is a generally elongated cylindrical structure. The attachment 25 is sized to be inserted in a bore 38 or a press-in clip bracket that is found on most hand-pulled or motorized golf carts. According to one exemplary embodiment, the attachment 25 has a diameter that is approximately the same diameter of a typical golf pencil. As those skilled in the art will appreciate, the diameter and/or length of the attachment 25 may be varied depending upon the intended application.

Figure 4:
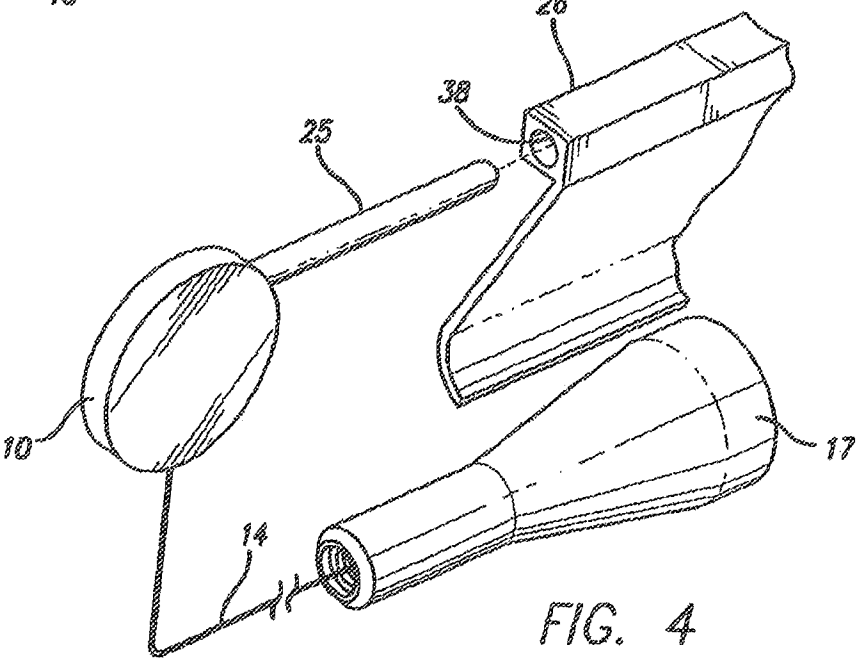
FIG. 4 is an exploded perspective view of an alternate exemplary embodiment.

As shown in FIG. 4, the attachment 25 can be inserted into the bore 38 that is found on a golf cart and the writing instrument such as a golf pencil (not shown) would be inserted into the mouth of the adapter. Accordingly, when the user wants to access or use the writing instrument, the user would grasp the writing instrument and be able to extend the writing instrument away from the retractor housing 10 and use the writing instrument. When finished, the user may release the writing instrument, and the instrument will be held in an easily accessible location to the user for future use.

Figure 7:
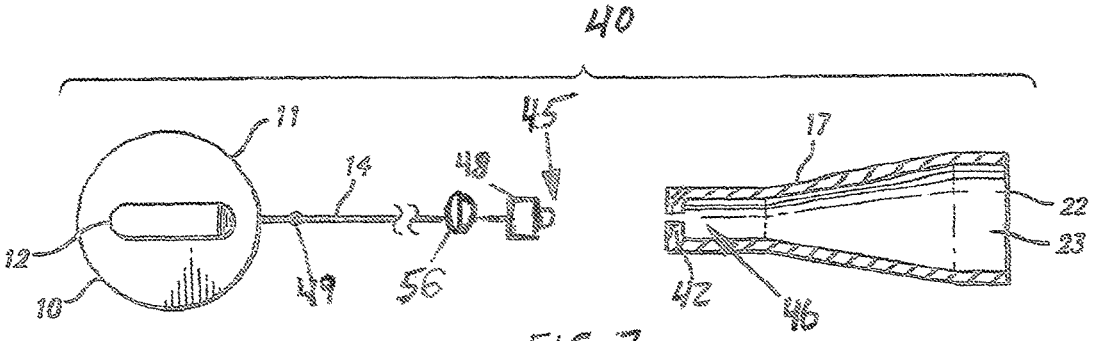
FIG. 7 is a cross-sectional side view of an embodiment including UHMWPE.

Referring now to FIG. 7, according to this disclosure there is shown a utility retractor 40 includes cable/tether 14 comprising Ultra High Molecular Weight Polyethylene (UHMWPE), which is subset of the thermoplastic polyethylene. Also known as high-modulus polyethylene, (HMPE), or high-performance polyethylene (HPPE), UHMWPE has extremely long chains, with a molecular mass usually between 2 and 6 million u. The longer chain serves to transfer load more effectively to the polymer backbone by strengthening intermolecular interactions. This structure results in a very tough material, with the highest impact strength of any thermoplastic presently made. More importantly to this application of a utility retractor is its ability of being very slippery and able to resist the environmental pitfalls common in the industry. Tests show a 10× increase in lifetime use of the utility retractor that uses the UHMWPE cable.

UHMWPE is odorless, tasteless, and nontoxic. It is highly resistant to corrosive chemicals except oxidizing acids; has extremely low moisture absorption and a very low coefficient of friction; is self-lubricating; and is highly resistant to abrasion, in some forms being 15 times more resistant to abrasion than carbon steel. Its coefficient of friction is significantly lower than that of nylon and acetal, and is comparable to that of polytetrafluoroethylene (PTFE, Teflon), but UHMWPE has better abrasion resistance than PTFE.

Another benefit of using UHMWPE as cable 14 is the ability to mark the cable 14 and remove these marks without damaging the material. The marks serve as distance measurements. So the user is able lay a customized pattern for their particular trade. For example: A carpenter building common walls for a house, will have to repeat the same measurements—such as a 16" center to center spacing for studs. Rather than having to continually use his tape measure while using his retractable holder of his carpenter pencil, he is able to use the marks on the UHMWPE cable/tether 14. If he later needs to make other spacing, he can mark the cable/tether 14 appropriately.

Because the UHMWPE is very flexible and compact, the user is also able to make a very compact knot anywhere along the length of the tether. These knots can be used in lieu of marks and because they can be made very "tight" they will not interfere with the winding and unwinding mechanisms and construction of the retractor.

Because UHMWPE is very strong compared to nylon and polyester, a smaller diameter cord can be used in the utility retractor, resulting in the ability to use a more compact retractor while achieving the same length or longer tether, meaning lower cost, less material, and a more environmentally friendly product.

Moreover, UHMWPE is very resistant to a variety of chemicals and dirt, another advantage in this application area. Construction adhesives typically will not stick to this UHMWPE. Dirt and dust can be washed off without affecting the material; in contrast, nylon and polyester are weakened by continued washing and are rendered worthless after touching adhesives.

Because UHMWPE is resistant to most known adhesives, special techniques are required for coupling the tether 14 to the retractor reel and to the flexible adaptor 17. Shown in FIG. 7 is a knot 45 on the distal end of UHMWPE tether 14 securable to a cylindrical fitting 48. The fitting 48 is forced through a centered bore 42 defined in the proximal end of the flexible adaptor 17, and retained in a cavity 46 in a friction fit arrangement.

According to another embodiment of this disclosure, at times the user may wish to slow down the speed of retraction of the flexible adaptor 17. It is possible for the retraction forces to be large enough to cause the flexible adaptor 17, and object being held, to bounce or flail indiscriminately when the adaptor 17 is suddenly stopped as a reaction to the collision with the body 10 of the retractor 11. This is typically a situation when the user attaches the retractor body 10 close to his head, for example, or attached to a shirt collar of pocket.

Figure 8:
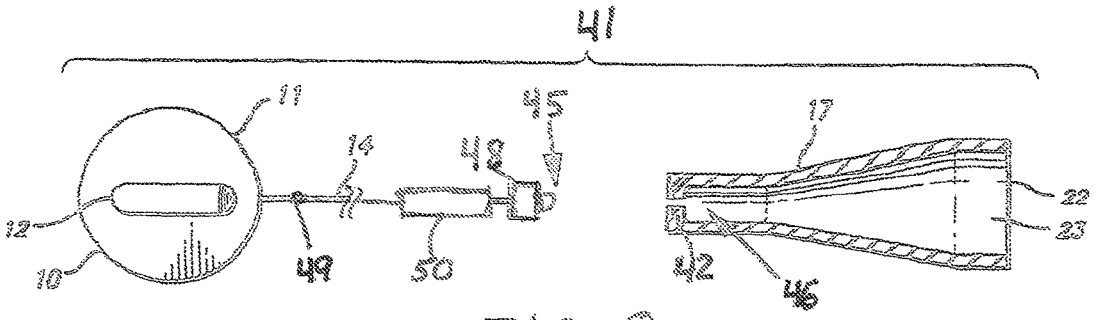
FIG. 8 is a view of an embodiment including a stop and energy absorber.
Figure 9:
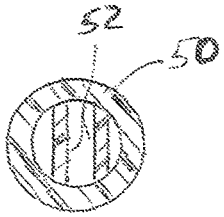
FIG. 9 is a cross-sectional view of the energy absorber shown in FIG. 8.

To mitigate the potential danger, shown in FIG. 8, a retractor 41 comprises a stop/energy absorber (SEA) 50. This absorber 50 can be in different forms and comprise of different materials in various embodiments. One such embodiment is as a tubular form of rubber, formed as a sleeve, shaped such that can it be slipped around the tether 14. In other embodiments, the absorber 50 can be comprises of a foam material. A cross sectional view of one embodiment of absorber 50 is shown in FIG. 9. The tubular form may have a circular cross section with one or two bars 52 spaced through which the tether 14 is threaded. In one configuration the absorber 50 is placed snugly against the flexible adapter 17.

Figure 10:
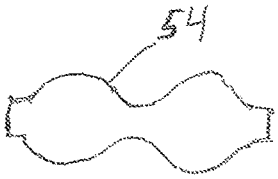
FIG. 10 is a side view of an energy absorber according to another embodiment.

In another embodiment, the absorber 50 may have an hour glass shape shown at 54 in FIG. 10. This shape is configured to compress or buckle to absorb the retraction energy of the adapter 17.

Yet another embodiment of absorber 50 is a large knot, a piece of tape, that is too large to retract into the opening of the retractor 11. In a home position, the absorber 50 offers minimal amount of force absorption when the tether is being retracted. In this position, the energy absorption is limited to the characteristics of the absorber 50 material and also the shape of the absorber 50. The absorber 50 can be engineered to be shaped for better force absorption including, but not limited to, any number of irregular shapes and how tightly the absorber 50 grips the tether 14.

The user may desire to increase the absorption of the retracting flexible adapter 17. This could be the situation if the retractor 11 is attached close to the user's head—perhaps on a shirt collar, pocket or hat. As adapter 17 is pulled out further from the retractor 11, more energy is stored in the internal coil spring and that energy that will be dissipated when it is released. In order to dissipate the forces further from the housing 10 and the person's head, the adapter 50 can be selectively repositioned on the tether 14 4"-6" from the housing 10. If the adapter 17 is released, the absorber 50 will make the first impact with the housing 10. The absorber 50 will absorb the energy as the SEA, and it may slide somewhat along the 4"-6" tether 14 but its velocity will be slowed down enough to flop harmlessly away from the retractor 11 and the person to whom it is attached. The adapter 17 and the cylindrical fitting is secured against the typical pull forced of the user and retractor.

At times, the user may wish to disengage the flexible adapter 17 and instrument from the tether 14. As shown in FIG. 7, a magnetic or frictional fit coupler 56 allows this disconnect and also prevents the tether 14 from retracting into the housing 10 of the retractor 11. In one embodiment, a pair of magnets comprise the magnetic coupler. Upon magnet separation, the flexible adapter 17 and instrument may then be magnetically adhered to the housing 10 of the retractor 11 or other metal item.

While exemplary embodiments have been described, it is recognized that additional variations may be devised without departing from the inventive concept.

The invention claimed is:

1. A retractable device for retaining a writing instrument, comprising:

a retractor comprising a retractor body housing a cable, the cable having a first end positioned within the retractor body and a second end positioned outside the retractor body, wherein the cable is selectively extendable from the retractor body and retractable into the retractor body;

a selectively detachable member comprising a pair of magnets disposed between the first end and the second end of the cable, or at the second end of the cable, configured to allow separation of the retractor body and the adapter; and an adapter coupled to the second end, the adapter having a recess configured to selectively and seemingly receive a writing instrument, wherein the cable comprises of an ultra high molecular weight polyethylene (UHMWPE) material.

2. The retractable device as specified in claim 1 further comprising an energy absorbing member disposed between the first end and the second end of the cable, the energy absorbing member configured to restrict the adapter from striking the retractor body when retracted.

3. The retractable device as specified claim 2 wherein the energy absorbing member is disposed proximate the second end of the cable.

4. The retractable device as specified in claim 2 wherein the energy absorbing member comprises a resilient material.

5. The retractable as specified its claim 4 wherein the energy absorbing member comprises an elongated member extending along a portion of the cable.

6. The retractable device as specified in claim 5 wherein the elongated member comprises a sleeve.

7. The retractable device as specified in claim 4 wherein the energy absorbing member is configured to compress when the adapter approaches the retractor body.

8. The retractable device specified in claim 2 wherein the energy absorbing member is configured to be selectively positioned on the cable.

9. The retractable device as specified in claim 1 wherein the cable has a protuberance at the second end, and the adapter is coupled to the protuberance.

10. The retractable device as specified in claim 9 wherein the adapter has a bore, and the protuberance is secured through the bore in a friction fit arrangement.

11. The retractable device as specified in claim 9 wherein the protuberance comprises a knot formed in the cable distal end.

12. The retractable device as specified in claim 11 further comprising a cylindrical member disposed adjacent the knot, wherein the cylindrical member is also configured to be disposed through the bore in a friction fit arrangement.

* * * * *